US011421312B2

(12) United States Patent
Takeda et al.

(10) Patent No.: US 11,421,312 B2
(45) Date of Patent: Aug. 23, 2022

(54) METHOD FOR MANUFACTURING HOT-DIP GALVANIZED STEEL SHEET

(71) Applicant: JFE STEEL CORPORATION, Tokyo (JP)

(72) Inventors: Gentaro Takeda, Tokyo (JP); Yoichi Makimizu, Tokyo (JP); Gosuke Ikeda, Tokyo (JP); Hideyuki Takahashi, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 416 days.

(21) Appl. No.: 16/607,813

(22) PCT Filed: Apr. 16, 2018

(86) PCT No.: PCT/JP2018/015737
§ 371 (c)(1),
(2) Date: Oct. 24, 2019

(87) PCT Pub. No.: WO2018/207560
PCT Pub. Date: Nov. 15, 2018

(65) Prior Publication Data

US 2020/0190652 A1 Jun. 18, 2020

(30) Foreign Application Priority Data

May 11, 2017 (JP) ..... JP2017-094930

(51) Int. Cl.
*C23C 2/40* (2006.01)
*C23C 2/06* (2006.01)
(Continued)

(52) U.S. Cl.
CPC ..... *C23C 2/40* (2013.01); *C21D 8/0257* (2013.01); *C21D 9/46* (2013.01); *C22C 38/02* (2013.01);
(Continued)

(58) Field of Classification Search
CPC .... C23C 2/40; C23C 2/02; C23C 2/06; C21D 8/0257; C21D 9/46; C22C 38/02;
(Continued)

(56) References Cited

U.S. PATENT DOCUMENTS 6,591,215 B1 * 7/2003 Blumenthal ..... C21D 1/76 702/136
9,932,659 B2 4/2018 Tanaka et al.
(Continued)

FOREIGN PATENT DOCUMENTS

EP 2224033 A1 9/2010
JP H0860254 A * 3/1996 ..... C21D 1/74
(Continued)

OTHER PUBLICATIONS

Jun. 15, 2020, the Extended European Search Report issued by the European Patent Office in the corresponding European Patent Application No. 18797789.7.
(Continued)

*Primary Examiner* — Anthony M Liang
(74) *Attorney, Agent, or Firm* — Kenja IP Law PC

(57) ABSTRACT

A method comprises: annealing a steel sheet by conveying the steel sheet through a heating zone, a soaking zone, and a cooling zone in the stated order in an annealing furnace; and then applying a hot-dip galvanized coating onto the steel sheet discharged from the cooling zone. Reducing or non-oxidizing humidified gas and reducing or non-oxidizing dry gas are supplied into the soaking zone. A CO gas concentration is measured using a CO gas concentration meter provided in an exhaust portion for gas in the soaking zone. A decarburized layer thickness of the steel sheet is calculated from the measured CO gas concentration. At least one of a flow rate and a dew point of the humidified gas is
(Continued)

controlled so that the calculated decarburized layer thickness is less than or equal to a predetermined thickness.

4 Claims, 2 Drawing Sheets

(51) Int. Cl.

| | |
|---|---|
| ***C23C 2/02*** | (2006.01) |
| ***C21D 9/46*** | (2006.01) |
| ***C21D 8/02*** | (2006.01) |
| ***C22C 38/02*** | (2006.01) |
| ***C22C 38/04*** | (2006.01) |
| ***C22C 38/12*** | (2006.01) |
| ***C22C 38/14*** | (2006.01) |
| ***C22C 38/32*** | (2006.01) |

(52) U.S. Cl.
CPC ..... *C22C 38/04* (2013.01); *C22C 38/12* (2013.01); *C22C 38/14* (2013.01); *C22C 38/32* (2013.01); *C23C 2/02* (2013.01); *C23C 2/06* (2013.01)

(58) Field of Classification Search
CPC ..... C22C 38/04; C22C 38/12; C22C 38/14; C22C 38/32
See application file for complete search history.

(56) References Cited

U.S. PATENT DOCUMENTS

2007/0051438 A1* 3/2007 Honda ..... C23C 2/02 148/533
2009/0123651 A1 5/2009 Okada
2011/0008546 A1* 1/2011 Suzuki ..... C22C 1/002 427/431
2015/0225829 A1* 8/2015 Fujita ..... C22C 38/28 148/504
2016/0222500 A1* 8/2016 Tanaka ..... C21D 6/005
2016/0230259 A1* 8/2016 Tanaka ..... C22C 38/06
2016/0363372 A1* 12/2016 Takeda ..... C23C 2/02
2018/0100209 A1* 4/2018 Dubois ..... C21D 9/46
2018/0237896 A1 8/2018 Takeda et al.

FOREIGN PATENT DOCUMENTS

| | | | |
|---|---|---|---|
| JP | H0860254 | A | 3/1996 |
| JP | 2010202959 | A | 9/2010 |
| JP | 2015054990 | A | 3/2015 |
| JP | 2016117921 | A | 6/2016 |
| WO | 2007043273 | A1 | 4/2007 |
| WO | 2015129202 | A1 | 9/2015 |
| WO | 2016169918 | A1 | 10/2016 |
| WO | 2017072989 | A1 | 5/2017 |

OTHER PUBLICATIONS

Jul. 10, 2018, International Search Report issued in the International Patent Application No. PCT/JP2018/015737.
Feb. 2, 2021, Office Action issued by the China National Intellectual Property Administration in the corresponding Chinese Patent Application No. 201880030312.3 with English language search report.
Tai-Xiong Guo et al., Influence of Process Conditions on Spangle Size of Hot Dip Al—Zn Alloy Coating, Material Protection, Dec. 2015, pp. 32-36, vol. 48, No. 12.

* cited by examiner

METHOD FOR MANUFACTURING HOT-DIP GALVANIZED STEEL SHEET

TECHNICAL FIELD

The present disclosure relates to a method for manufacturing a hot-dip galvanized steel sheet using a continuous hot-dip galvanizing device that includes: an annealing furnace in which a heating zone, a soaking zone, and a cooling zone are arranged in this order; and a hot-dip galvanizing line located downstream of the cooling zone.

BACKGROUND

In recent years, the demand for high tensile strength steel sheets which contribute to more lightweight structures and the like is increasing in the fields of automobiles, household appliances, building products, etc. As high tensile strength steel sheets, for example, it is known that a steel sheet with favorable hole expandability can be manufactured by containing Si in steel, and a steel sheet with favorable ductility where retained austenite (γ) forms easily can be manufactured by containing Si or Al in steel.

However, in the case of manufacturing a galvannealed steel sheet using, as a base material, a high tensile strength steel sheet containing a large amount of Si (particularly, 0.2 mass % or more), the following problem arises. The galvannealed steel sheet is manufactured by, after heat-annealing the steel sheet as the base material at a temperature of about 600° C. to 900° C. in a reducing atmosphere or a non-oxidizing atmosphere, hot-dip galvanizing the steel sheet and further heat-alloying the galvanized coating.

Here, Si in the steel is an oxidizable element, and is selectively oxidized in a typically used reducing atmosphere or non-oxidizing atmosphere and concentrated at the surface of the steel sheet to form an oxide. This oxide decreases wettability with molten zinc in the galvanizing process, and causes non-coating. With an increase of the Si concentration in the steel, wettability decreases rapidly and non-coating occurs frequently. Even in the case where non-coating does not occur, there is still a problem of poor coating adhesion. Besides, if Si in the steel is selectively oxidized and concentrated at the surface of the steel sheet, a significant alloying delay arises in the alloying process after the hot-dip galvanizing, leading to considerably lower productivity.

In view of such problems, for example, JP 2010-202959 A (PTL 1) describes the following method. With use of a direct fired furnace (DFF), the surface of a steel sheet is oxidized and then the steel sheet is annealed in a reducing atmosphere to internally oxidize Si and prevent Si from being concentrated at the surface of the steel sheet, thus improving the wettability and adhesion of the hot-dip galvanizing. PTL 1 describes that the reducing annealing after heating may be performed by a conventional method (dew point: −30° C. to −40° C.).

WO2007/043273 A1 (PTL 2) describes the following technique. In a continuous annealing and hot-dip coating method that uses an annealing furnace having an upstream heating zone, a downstream heating zone, a soaking zone, and a cooling zone arranged in this order and a hot-dip molten bath, annealing is performed under the following conditions to internally oxidize Si and prevent Si from being concentrated at the surface of the steel sheet: heating or soaking the steel sheet at a steel sheet temperature in the range of at least 300° C. by indirect heating; setting the atmosphere inside the furnace in each zone to an atmosphere of 1 vol % to 10 vol % hydrogen with the balance being nitrogen and inevitable impurities; setting the steel sheet end-point temperature during heating in the upstream heating zone to 550° C. or more and 750° C. or less and the dew point in the upstream heating zone to less than −25° C.; setting the dew point in the subsequent downstream heating zone and soaking zone to −30° C. or more and 0° C. or less; and setting the dew point in the cooling zone to less than −25° C. PTL 2 also describes humidifying mixed gas of nitrogen and hydrogen and introducing it into the downstream heating zone and/or the soaking zone.

JP H8-60254 A (PTL 3) describes the following method. In a continuous annealing furnace that is divided by atmosphere partitions and in which a buffer zone with an exhaust port, into which gas from adjacent zones flows, is provided between zones different in atmosphere conditions and an exhaust port is provided in the zone upstream of the buffer zone, for the purpose of maintaining the atmosphere gas flow in the furnace to a constant state and stabilizing the dew point in the furnace, the atmosphere flow in the furnace is controlled by detecting the CO concentration in the zone upstream of the buffer zone and controlling the aperture of the exhaust port in the zone and/or the buffer zone so that the CO concentration satisfies the target CO concentration.

JP 2016-117921 A (PTL 4) describes the following technique. A base steel sheet containing 0.8 mass % to 3.5 mass % Si is annealed in a reducing atmosphere containing at least one selected from the group consisting of hydrocarbon gas and carbon monoxide gas, to limit the thickness of the decarburized layer of the surface layer of the base steel sheet to 0.5 μm or less and thus prevent surface oxidation of Si.

CITATION LIST

Patent Literatures

PTL 1: JP 2010-202959 A
PTL 2: WO2007/043273 A1
PTL 3: JP H8-60254 A
PTL 4: JP 2016-117921 A

SUMMARY

Technical Problem

However, with the method described in PTL 1, although the coating adhesion after the reduction is favorable, the amount of Si internally oxidized tends to be insufficient, and Si in the steel causes the alloying temperature to be higher than typical temperature by 30° C. to 50° C., as a result of which the tensile strength of the steel sheet decreases. If the oxidation amount is increased to ensure a sufficient amount of Si internally oxidized, oxide scale attaches to rolls in the annealing furnace, inducing pressing flaws, i.e. pick-up defects, in the steel sheet. The means for simply increasing the oxidation amount is therefore not applicable.

With the method described in PTL 2, since the heating or soaking in the upstream heating zone, downstream heating zone, and soaking zone is performed by indirect heating, the oxidation of the surface of the steel sheet like that by direct firing in PTL 1 is unlikely to occur, and the internal oxidation of Si is insufficient as compared with PTL 1. The problem of an increase in alloying temperature is therefore more serious. Moreover, not only the amount of moisture brought into the furnace varies depending on the external air temperature change or the steel sheet type, but also the dew point of the mixed gas tends to vary depending on the external air temperature change, making it difficult to stably control the dew point in the optimal dew point range. Due to such large dew point variation, surface defects such as non-coating occur even within the aforementioned dew point ranges and temperature ranges. The manufacture of stable products is therefore difficult.

With the method described in PTL 3, a horizontal heating furnace for electrical steel sheets is used. Such a method is not applicable to a vertical annealing furnace for hot-dip galvanized steel sheets. The method described in PTL 3 aims to maintain constant CO concentration. In the case of continuous hot-dip galvanized steel sheets, however, the size and/or the carbon content of the steel sheet passed is changed as appropriate. Besides, the sheet passing speed is changed depending on the sheet thickness/sheet width. Hence, the amount of CO gas generated by decarburization varies significantly. There is thus no point in maintaining constant CO gas concentration. In the case of hot-dip galvanized steel sheets, if the surface layer of the steel sheet before galvanizing is excessively decarburized, a soft ferrite layer forms, and consequently the tensile strength decreases. An effective way of causing internal oxidation of Si and decreasing the alloying temperature is to increase the dew point of the soaking zone to about 0° C. Even with the same dew point, however, if an excessively decarburized layer is formed, desired mechanical properties cannot be obtained.

With the method described in PTL 4, decarburization is prevented using an annealing atmosphere containing hydrocarbon gas and/or carbon monoxide gas. This is, however, unfeasible because decarburization occurs even with a slight mount of moisture (up to about 200 ppm) that inevitably enters during operation. Moreover, since no specific method of monitoring the decarburization amount is indicated, it is impossible to reflect the method on actual operation.

It could therefore be helpful to provide a method for manufacturing a hot-dip galvanized steel sheet whereby favorable coating appearance can be obtained with high coating adhesion without a decrease in tensile strength even in the case of hot-dip galvanizing a steel sheet whose Si content is 0.2 mass % or more.

Solution to Problem

As a result of extensive studies, we learned the following: In the case of passing a steel sheet whose Si content is 0.2 mass % or more, by supplying humidified gas in addition to dry gas into the soaking zone to increase the dew point, internal oxidation of Si is facilitated, so that favorable coating appearance can be obtained with high coating adhesion. This process alone is, however, insufficient. By constantly monitoring the degree of decarburization of the steel sheet surface layer in the soaking zone and, based on the monitoring result, controlling at least one of the flow rate and dew point of the humidified gas to the soaking zone (i.e. the amount of moisture supplied to the soaking zone) to suppress excessive decarburization, a decrease in tensile strength can be prevented more reliably. We then discovered that the degree of decarburization can be monitored anytime by providing a CO gas concentration meter in an exhaust portion for gas in the soaking zone and measuring the CO gas concentration.

Based on these discoveries, we provide:

[1] A method for manufacturing a hot-dip galvanized steel sheet using a continuous hot-dip galvanizing device that includes: an annealing furnace in which a heating zone, a soaking zone, and a cooling zone are arranged in the stated order; and a hot-dip galvanizing line located downstream of the cooling zone, the method comprising: annealing a steel sheet by conveying the steel sheet through the heating zone, the soaking zone, and the cooling zone in the stated order in the annealing furnace; and applying a hot-dip galvanized coating onto the steel sheet discharged from the cooling zone, using the hot-dip galvanizing line, wherein reducing or non-oxidizing humidified gas and reducing or non-oxidizing dry gas are supplied into the soaking zone, a CO gas concentration is measured using a CO gas concentration meter provided in an exhaust portion for gas in the soaking zone, a decarburized layer thickness of the steel sheet is calculated from the measured CO gas concentration, and at least one of a flow rate and a dew point of the humidified gas is controlled so that the calculated decarburized layer thickness is less than or equal to a predetermined thickness.

[2] The method for manufacturing a hot-dip galvanized steel sheet according to [1], wherein the decarburized layer thickness is calculated based on the following Formula (1):

$$D=9.53\times10^{-7}\times V\cdot Gco/(LS\cdot W\cdot C) \quad (1)$$

where D is the decarburized layer thickness in μm, V is an amount of gas flowing into the soaking zone in $Nm^3$/hr, Gco is the CO gas concentration in ppm, LS is a sheet passing speed in m/s, W is a sheet width of the steel sheet in m, and C is a carbon content of the steel sheet in mass %.

[3] The method for manufacturing a hot-dip galvanized steel sheet according to [1] or [2], wherein the predetermined thickness is 20 μm.

[4] The method for manufacturing a hot-dip galvanized steel sheet according to any one of [1] to [3], wherein the continuous hot-dip galvanizing device includes an alloying line located downstream of the hot-dip galvanizing line, and the method further comprises heat-alloying the galvanized coating applied on the steel sheet, using the alloying line.

Advantageous Effect

It is thus possible to provide a method for manufacturing a hot-dip galvanized steel sheet whereby favorable coating appearance can be obtained with high coating adhesion without a decrease in tensile strength even in the case of hot-dip galvanizing a steel sheet whose Si content is 0.2 mass % or more.

DETAILED DESCRIPTION

Figure 1:
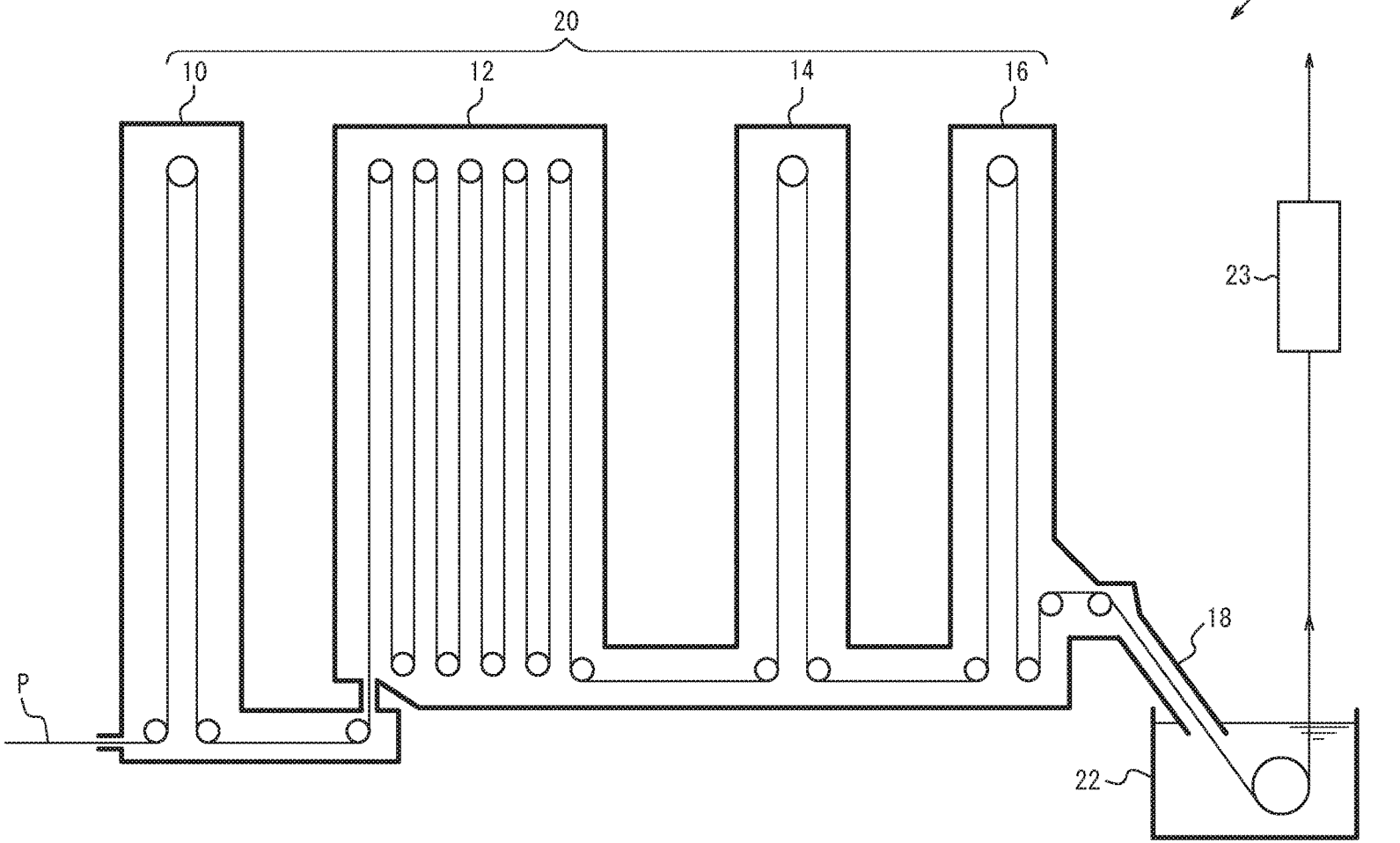
FIG. 1 is a sectional diagram illustrating the structure of a continuous hot-dip galvanizing device 100 used in one of the disclosed embodiments.

The structure of a continuous hot-dip galvanizing device 100 used in a method for manufacturing a hot-dip galvanized steel sheet according to one of the disclosed embodiments will be described below, with reference to FIG. 1. The continuous hot-dip galvanizing device 100 includes: a vertical annealing furnace 20 in which a heating zone 10, a soaking zone 12, and cooling zones 14 and 16 are arranged in this order; a hot-dip galvanizing bath 22 as a hot-dip galvanizing line located downstream of the cooling zone 16 in a steel sheet passing direction; and an alloying line 23 located downstream of the hot-dip galvanizing bath 22 in the steel sheet passing direction. In this embodiment, the cooling zone includes a first cooling zone 14 (rapid cooling zone) and a second cooling zone 16 (slow cooling zone). A snout 18 connected to the second cooling zone 16 has its tip immersed in the hot-dip galvanizing bath 22, thus connecting the annealing furnace 20 and the hot-dip galvanizing bath 22.

A steel sheet P is introduced from a steel sheet introduction port in the lower part of the heating zone 10 into the heating zone 10. One or more hearth rolls are arranged in the upper and lower parts in each of the zones 10, 12, 14, and 16. In the case where the steel sheet P is folded back by 180 degrees at one or more hearth rolls, the steel sheet P is conveyed vertically a plurality of times inside the corresponding predetermined zone, forming a plurality of passes. While FIG. 1 illustrates an example of having 2 passes in the heating zone 10, 10 passes in the soaking zone 12, 2 passes in the first cooling zone 14, and 2 passes in the second cooling zone 16, the numbers of passes are not limited to such, and may be set as appropriate depending on the processing conditions. At some hearth rolls, the steel sheet P is not folded back but changed in direction at the right angle to move to the next zone. The steel sheet P is thus annealed in the annealing furnace 20 by being conveyed through the heating zone 10, the soaking zone 12, and the cooling zones 14 and 16 in this order.

Each of the zones 10, 12, 14, and 16 is a vertical furnace. The height of each zone is not limited, but may be about 20 m to 40 m. The length of each zone (the right-left direction in FIG. 1) may be determined as appropriate depending on the number of passes in the zone. For example, the heating zone 10 with 2 passes may be about 0.8 m to 2 m, the soaking zone 12 with 10 passes may be about 10 m to 20 m, and each of the first cooling zone 14 and the second cooling zone 16 with 2 passes may be about 0.8 m to 2 m.

Adjacent zones in the annealing furnace 20 communicate through a communication portion connecting the upper parts or lower parts of the respective zones. In this embodiment, the heating zone 10 and the soaking zone 12 communicate through a throat (restriction portion) connecting the lower parts of the respective zones. The soaking zone 12 and the first cooling zone 14 communicate through a throat connecting the lower parts of the respective zones. The first cooling zone 14 and the second cooling zone 16 communicate through a throat connecting the lower parts of the respective zones. The height of each throat may be set as appropriate, but is preferably as low as possible to enhance the independence of the atmosphere in each zone. The gas in the annealing furnace 20 flows from downstream to upstream in the furnace, and is discharged from the steel sheet introduction port in the lower part of the heating zone 10.

(Heating Zone)

In this embodiment, the heating zone 10 is capable of indirectly heating the steel sheet P using a radiant tube (RT) or an electric heater. The average temperature in the heating zone 10 is preferably adjusted to 700° C. to 900° C. The gas from the soaking zone 12 flows into the heating zone 10, and simultaneously reducing gas or non-oxidizing gas is supplied into the heating zone 10. As the reducing gas, $H_2$—$N_2$ mixed gas is typically used. An example is gas (dew point: about −60° C.) having a composition containing 1 vol % to 20 vol % $H_2$ with the balance being $N_2$ and inevitable impurities. An example of the non-oxidizing gas is gas (dew point: about −60° C.) having a composition containing $N_2$ and inevitable impurities. The supply of the gas to the heating zone 10 is not limited, but the gas is preferably supplied from introduction ports in two or more locations in the height direction and one or more locations in the longitudinal direction so that the gas is evenly introduced into the heating zone. The flow rate of the gas supplied to the heating zone is measured by a gas flowmeter (not illustrated) provided in the pipe. The flow rate is not limited, but may be about 10 to 100 ($Nm^3$/hr).

(Soaking Zone)

In this embodiment, the soaking zone 12 is capable of indirectly heating the steel sheet P using a radiant tube (not illustrated) as heating means. The average temperature in the soaking zone 12 is preferably adjusted to 700° C. to 1000° C.

Reducing gas or non-oxidizing gas is supplied to the soaking zone 12. As the reducing gas, $H_2$—$N_2$ mixed gas is typically used. An example is gas (dew point: about −60° C.) having a composition containing 1 vol % to 20 vol % $H_2$ with the balance being $N_2$ and inevitable impurities. An example of the non-oxidizing gas is gas (dew point: about −60° C.) having a composition containing $N_2$ and inevitable impurities.

In this embodiment, the reducing gas or non-oxidizing gas supplied to the soaking zone 12 has two forms, namely, humidified gas and dry gas. Here, "dry gas" is reducing gas or non-oxidizing gas having a dew point of about −60° C. to −50° C. and not humidified by a humidifying device, and "humidified gas" is gas humidified by the humidifying device so that the dew point is 0° C. to 30° C.

When manufacturing a high tensile strength steel sheet having a chemical composition containing 0.2 mass % or more Si, the humidified gas is supplied to the soaking zone 12 in addition to the dry gas, in order to increase the dew point in the soaking zone. When manufacturing a steel sheet whose Si content is less than 0.2 mass % (e.g. a normal steel sheet with a tensile strength of about 270 MPa), on the other hand, only the dry gas is supplied to the soaking zone 12 without supplying the humidified gas, to prevent oxidation of the steel sheet surface.

Figure 2:
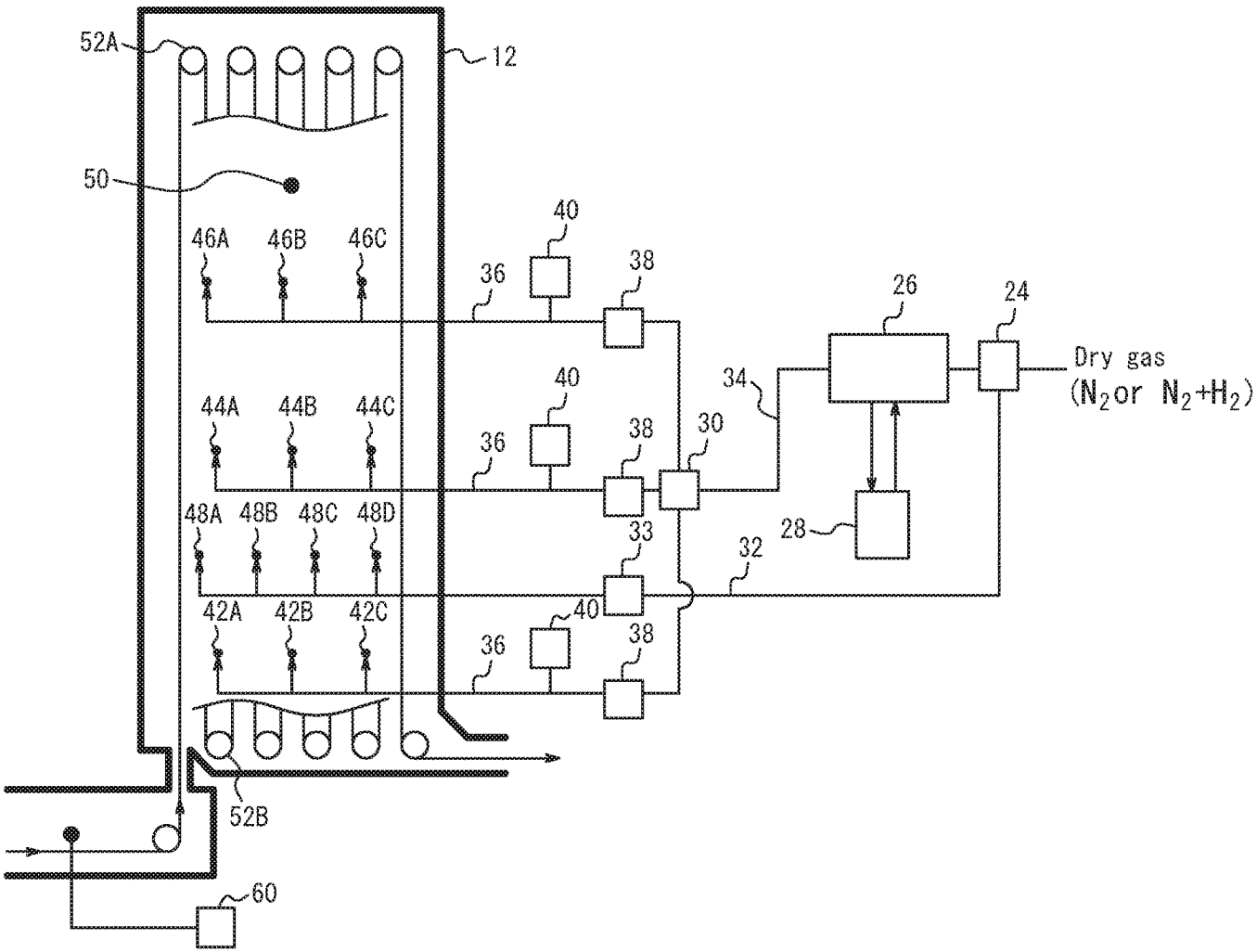
FIG. 2 is a schematic diagram illustrating a supply system of humidified gas and dry gas to a soaking zone 12 in FIG. 1.

FIG. 2 is a schematic diagram illustrating a supply system of humidified gas and dry gas to the soaking zone 12. The humidified gas is supplied through three systems, namely, humidified gas supply ports 42A, 42B, and 42C, humidified gas supply ports 44A, 44B, and 44C, and humidified gas supply ports 46A, 46B, and 46C. In FIG. 2, a gas distribution device 24 feeds part of the reducing gas or non-oxidizing gas (dry gas) into a humidifying device 26, and the remaining part through a dry gas pipe 32 into the soaking zone 12 from dry gas supply ports 48A, 48B, 48C, and 48D as dry gas. Reference sign 33 is a dry gas flowmeter.

The positions and the number of the dry gas supply ports are not limited, and may be determined as appropriate based on various conditions. Preferably, a plurality of dry gas supply ports are located at the same height position along the longitudinal direction of the soaking zone. Preferably, the dry gas supply ports are evenly distributed in the longitudinal direction of the soaking zone.

The gas humidified by the humidifying device 26 passes through a humidified gas pipe 34, is distributed among the three systems by a humidified gas distribution device 30, and supplied through respective humidified gas pipes 36 into the soaking zone 12 from humidified gas supply ports 42A to 42C, humidified gas supply ports 44A to 44C, and humidified gas supply ports 46A to 46C.

The positions and the number of the humidified gas supply ports are not limited, and may be determined as appropriate based on various conditions. Preferably, a humidified gas supply port is provided at one or more locations in each of four sections formed by dividing the soaking zone 12 into halves in the vertical direction and into halves in the horizontal direction (i.e. entrance to exit direction). This enables uniform dew point control of the whole soaking zone 12. Reference sign 38 is a humidified gas flowmeter, and reference sign 40 is a humidified gas dew point meter. Since the dew point of the humidified gas may change due to, for example, slight dew condensation in the humidified gas pipe 34 and/or 36, the dew point meter 40 is desirably located immediately in front of each of the humidified gas supply ports 42, 44, and 46.

The humidifying device 26 includes a humidifying module having a fluorine or polyimide hollow fiber membrane, flat membrane, or the like. Dry gas flows inside the membrane, whereas pure water adjusted to a predetermined temperature in a circulating constant-temperature water bath 28 circulates outside the membrane. The fluorine or polyimide hollow fiber membrane or flat membrane is a type of ion exchange membrane with affinity for water molecules. When moisture content differs between the inside and outside of the hollow fiber membrane, a force for equalizing the moisture content difference emerges and, with this force as a driving force, moisture transmits through the membrane and moves toward the part with lower moisture content. The temperature of dry gas varies with seasonal or daily air temperature change. In this humidifying device, however, heat exchange is possible by ensuring a sufficient contact area between gas and water through the vapor permeable membrane. Accordingly, regardless of whether the dry gas temperature is higher or lower than the circulating water temperature, the dry gas is humidified to the same dew point as the set water temperature, thus achieving highly accurate dew point control. The dew point of the humidified gas can be controlled to any value in the range of 5° C. to 50° C. When the dew point of the humidified gas is higher than the pipe temperature, there is a possibility that dew condensation occurs in the pipe and dew condensation water enters directly into the furnace. The humidified gas pipe is therefore heated/heat-retained to be not less than the dew point of the humidified gas and not less than the external air temperature.

In this embodiment, it is important to control at least one of the flow rate and dew point of the humidified gas based on the degree of decarburization of the steel sheet caused by the moisture of the humidified gas supplied into the soaking zone. When the soaking zone is humidified so that the dew point of the soaking zone is −20° C. or more, moisture and Si react to facilitate internal oxidation of Si in the steel sheet surface layer, and also moisture and carbon in the steel sheet surface layer react to cause a decarburization phenomenon. This reaction is expressed as:

$$H_2O+C \rightarrow H_2+CO.$$

According to this relational expression, 1 mol of CO gas is generated from 1 mol of carbon (C).

If the steel sheet surface layer is excessively decarburized, a soft ferrite layer forms, and consequently the tensile strength decreases. In view of this, in this embodiment, a CO gas concentration meter 60 is provided in an exhaust portion for gas in the soaking zone to measure the CO gas concentration, as illustrated in FIG. 2. The thickness of the decarburized layer (decarburized layer thickness) of the steel sheet is calculated from the measured CO concentration, and at least one of the flow rate and dew point of the humidified gas (i.e. the amount of moisture supplied to the soaking zone) is controlled so that the calculated decarburized layer thickness is less than or equal to a predetermined thickness. By constantly monitoring the CO concentration during operation to recognize the degree of decarburization and control at least one of the flow rate and dew point of the humidified gas anytime in this way, a decrease of the tensile strength of the steel sheet can be reduced sufficiently.

Furthermore, as a result of extensive studies on the relationship between the CO gas concentration and the decarburized layer, we discovered that the following Formula (1) holds. It is therefore preferable to calculate the decarburized layer thickness based on the following Formula (1):

$$D=9.53\times10^{-7}\times V\cdot Gco/(LS\cdot W\cdot C) \quad (1)$$

where D is the decarburized layer thickness [μm], V is the amount of gas flowing into the soaking zone [$Nm^3$/hr], Gco is the CO gas concentration [ppm], LS is the sheet passing speed [m/s], W is the sheet width of the steel sheet [m], and C is the carbon content of the steel sheet [mass %].

As mentioned above, the gas in the annealing furnace 20 flows from downstream to upstream in the furnace, and is discharged from the steel sheet introduction port in the lower part of the heating zone 10. Hence, in this embodiment, the amount of gas flowing into the soaking zone 12 is the sum of the flow rate of the humidified gas and dry gas charged into the soaking zone 12 and the flow rate of the gas charged into the cooling zones 14 and 16.

In terms of reducing a decrease of the tensile strength more sufficiently, it is preferable to control at least one of the flow rate and dew point of the humidified gas so that the decarburized layer thickness D is 20 μm or less.

For example, in the case where at least one of the sheet passing speed LS, the sheet width W of the steel sheet, and the carbon content C of the steel sheet is changed, the changed value is substituted into Formula (1). The CO gas concentration Gco is then continuously monitored, and at least one of the flow rate and dew point of the humidified gas is controlled so that D is less than or equal to the predetermined value.

Since there is a distribution of CO concentration in the soaking zone 12, the CO concentration is desirably measured at the gas outlet where the gas in the soaking zone gathers. Typically, in the case where the heating zone 10 and the soaking zone 12 are connected to each other, the gas in the soaking zone 12 flows to the heating zone 10 and is used as the gas for the heating zone. Accordingly, the CO concentration meter 60 is desirably located at the connecting portion between the heating zone and the soaking zone, as illustrated in FIG. 2.

The flow rate of the humidified gas supplied into the soaking zone 12 is not limited as long as the foregoing control is performed, but is roughly maintained in the range of 100 to 400 ($Nm^3$/hr). The flow rate of the dry gas supplied into the soaking zone 12 is not limited, but is roughly maintained in the range of 10 to 300 ($Nm^3$/hr) when passing a high tensile strength steel sheet having a chemical composition containing 0.2 mass % or more Si.

(Cooling Zone)

In this embodiment, the cooling zones 14 and 16 cool the steel sheet P. The steel sheet P is cooled to about 480° C. to 530° C. in the first cooling zone 14, and cooled to about 470° C. to 500° C. in the second cooling zone 16.

The cooling zones 14 and 16 are also supplied with the aforementioned reducing gas or non-oxidizing gas. Here, only the dry gas is supplied. The supply of the dry gas to the cooling zones 14 and 16 is not limited, but the dry gas is preferably supplied from introduction ports in two or more locations in the height direction and two or more locations in the longitudinal direction so that the dry gas is evenly introduced into the cooling zones. The total gas flow rate of the dry gas supplied to the cooling zones 14 and 16 is measured by a gas flowmeter (not illustrated) provided in the pipe. The total gas flow rate is not limited, but may be about 200 to 1000 ($Nm^3$/hr).

(Hot-Dip Galvanizing Bath)

The hot-dip galvanizing bath 22 can be used to apply a hot-dip galvanized coating onto the steel sheet P discharged from the second cooling zone 16. The hot-dip galvanizing may be performed according to a usual method.

(Alloying Line)

The alloying line 23 can be used to heat-alloy the galvanized coating applied on the steel sheet P. The alloying treatment may be performed according to a usual method. In this embodiment, the alloying temperature is kept from being high, thus preventing a decrease of the tensile strength of the produced galvannealed steel sheet. Note that the alloying line 23 and the alloying treatment by the alloying line 23 are not essential in the present disclosure. The effect of obtaining favorable coating appearance and high tensile strength can be achieved even without alloying treatment.

(Chemical Composition of Steel Sheet)

The steel sheet P subjected to annealing and hot-dip galvanizing is not limited, but the advantageous effects according to the present disclosure can be effectively achieved in the case where the steel sheet has a chemical composition in which Si content is 0.2 mass % or more, i.e. high tensile strength steel. A preferred chemical composition of the steel sheet will be described below. In the following description, "%" denotes mass %.

C improves workability as a result of formation of retained austenite phase, martensite phase, or the like as steel microstructure. The C content is preferably 0.025% or more, but no lower limit is placed on the C content in the present disclosure. If the C content is more than 0.3%, weldability decreases. The C content is therefore preferably 0.3% or less.

Si is an element effective in strengthening the steel to obtain favorable material. Accordingly, for high tensile strength steel sheets, the Si content is set to 0.2% or more. If the Si content is less than 0.2%, an expensive alloying element is required in order to obtain high strength. If the Si content is more than 2.5%, oxide layer formation in oxidation treatment is inhibited. Besides, the alloying temperature increases, making it difficult to achieve desired mechanical properties. The Si content is therefore preferably 2.5% or less.

Mn is an element effective in strengthening the steel. To ensure a tensile strength of 590 MPa or more, the Mn content is preferably 0.5% or more. If the Mn content is more than 3.0%, it may be difficult to ensure weldability, coating adhesion, and strength-ductility balance. The Mn content is therefore preferably 0.5% to 3.0%. For a tensile strength of 270 MPa to 440 MPa, Mn is added as appropriate in the range of 1.5% or less.

P is an element effective in strengthening the steel, but delays alloying reaction between zinc and steel. Accordingly, in the case where the Si content in the steel is 0.2% or more, the P content is preferably 0.03% or less. Otherwise, P is added as appropriate depending on the strength. In terms of refining cost, the P content is preferably 0.001% or more.

S has little influence on the strength of the steel, but influences oxide layer formation in hot rolling/cold rolling. The S content is therefore preferably 0.005% or less. In terms of refining cost, the S content is preferably 0.0002% or more.

In addition to the foregoing elements, for example, one or more of elements such as Cr, Mo, Ti, Nb, V, and B may be optionally added. The balance is Fe and inevitable impurities.

Examples (Experimental Conditions)

The continuous hot-dip galvanizing device illustrated in FIGS. 1 and 2 was used to anneal each steel sheet whose chemical composition is shown in Table 1 (the balance being Fe and inevitable impurities) under the annealing conditions shown in Table 2, and then hot-dip galvanize and alloy the steel sheet.

A RT furnace having a volume of 200 $m^3$ was used as the heating zone. The average temperature in the heating zone was set to 700° C. to 800° C. As dry gas supplied into the heating zone, gas (dew point: −50° C.) having a composition containing 15 vol % $H_2$ with the balance being $N_2$ and inevitable impurities was used. The flow rate of the dry gas into the heating zone was set to 100 $Nm^3$/hr.

A RT furnace having a volume of 700 $m^3$ was used as the soaking zone. The average temperature in the soaking zone was set to the value shown in Table 2. As dry gas, gas (dew point: −50° C.) having a composition containing 10 vol % $H_2$ with the balance being $N_2$ and inevitable impurities was used. Part of the dry gas was humidified by the humidifying device having a hollow fiber membrane-type humidifying portion, to prepare humidified gas. The hollow fiber membrane-type humidifying portion was made up of 10 membrane modules, in which circulating water of 100 L/min at the maximum was flown. Dry gas supply ports and humidified gas supply ports were arranged at the positions illustrated in FIG. 2. The flow rates of the dry gas and the humidified gas supplied into the soaking zone are shown in Table 2.

In Table 2, the "dew point" for the soaking zone indicates the dew point in the soaking zone measured at the position of a dew point measurement port 50 in FIG. 2. The "humidified gas dew point" for the soaking zone indicates the dew point measured by the humidified gas dew point meter 40 in FIG. 2.

The dry gas (dew point: −50° C.) was supplied to the first and second cooling zones from their lowermost parts with the flow rate shown in Table 2.

The temperature of the molten bath was set to 460° C., the Al concentration in the molten bath was set to 0.130%, and the coating weight was adjusted to 50 g/$m^2$ per side by gas wiping. After the hot-dip galvanizing, alloying treatment was performed in an induction heating-type alloying furnace so that the coating alloying degree (Fe content) was 10% to 13%. The alloying temperature in the treatment is shown in Table 2.

In operation of each level, CO gas in the soaking zone was constantly monitored by the CO concentration meter located at the position illustrated in FIG. 2. The following coating appearance evaluation and tensile strength measurement were performed on a galvannealed steel sheet sample obtained from the steel sheet located in the soaking zone when the CO concentration shown in Table 2 was detected.

No. 1 and No. 5 in Table 2 are Comparative Examples not supplied with humidified gas. In No. 2 to 4 (steel A) and No. 6 to 8 (steel B) in Table 2, the target decarburized layer thickness was set to 20 μm or less. The "calculated decarburized layer thickness D" in Table 2 indicates the decarburized layer thickness calculated by substituting the CO concentration Gco, the sheet passing speed LS, the sheet width W of the steel sheet, the C content of the steel sheet, and the amount V of gas flowing into the soaking zone (the sum of the humidified gas flow rate and the dry gas flow rate of the soaking zone and the gas flow rate of the cooling zone) into Formula (1). The "decarburized layer evaluation" in Table 2 indicates "good" in the case where the calculated decarburized layer thickness D was less than or equal to the target decarburized layer thickness, and "poor" in the case where the calculated decarburized layer thickness D was more than the target decarburized layer thickness.

(Evaluation Method)

The evaluation of the coating appearance was conducted through inspection by an optical surface defect meter (detection of non-coating defects of φ0.5 or more or roll pick-up flaws) and visual determination of alloying unevenness. Samples accepted on all criteria were rated "good", samples having a low degree of alloying unevenness were rated "fair", and samples rejected on at least one of the criteria were rated "poor". The results are shown in Table 2.

Regarding the tensile strength, steel with steel sample ID A was rated as "pass" when the tensile strength was 980 MPa or more, and steel with steel sample ID B was rated as "pass" when the tensile strength was 780 MPa or more. The results are shown in Table 2.

(Evaluation Results)

In Comparative Examples No. 1 and No. 5, humidified gas was not supplied, so that internal oxidation of Si was not facilitated and the coating appearance was impaired. Besides, the alloying temperature was high, and consequently the tensile strength was "fail". In Comparative Examples No. 2 and No. 6, humidified gas was supplied, so that the coating appearance was "pass". However, the tensile strength was "fail" due to the operating conditions with which the calculated decarburized layer thickness was more than the target decarburized layer thickness. This is considered to be because soft ferrite formed in the surface layer. In Examples No. 3, 4, 7, and 8, on the other hand, humidified gas was supplied and also the operating conditions were such that the calculated decarburized layer thickness was less than the target decarburized layer thickness, and accordingly both the coating appearance and the tensile strength were "pass".

It can be understood from this that a hot-dip galvanized steel sheet having excellent coating appearance and high tensile strength can be stably manufactured by monitoring the CO concentration during operation and controlling the humidified gas so that the decarburized layer thickness calculated from the measured CO concentration is less than or equal to a predetermined thickness.

TABLE 1

| Steel sample ID | C | Si | Mn | P | (mass %) S |
|---|---|---|---|---|---|
| A | 0.15 | 1.4 | 1.9 | 0.01 | 0.001 |
| B | 0.10 | 1.5 | 2.7 | 0.01 | 0.001 |

TABLE 2

| | Steel composition | | | | Soaking zone | | | | | |
|---|---|---|---|---|---|---|---|---|---|---|
| No | Steel sample ID | C content (%) | Sheet width W (m) | Sheet passing speed LS (m/s) | Dew point (° C.) | Average temperature (° C.) | Dry gas flow rate ($Nm^3$/hr) | Humidified gas flow rate ($Nm^3$/hr) | Humidified gas dew point (° C.) | CO concentration Gco (ppm) |
| 1 | A | 0.15 | 0.9 | 1.6 | −45.2 | 832 | 530 | 0 | — | 20 |
| 2 | A | 0.15 | 0.9 | 1.6 | −9.3 | 833 | 260 | 300 | 19.0 | 5300 |
| 3 | A | 0.15 | 0.9 | 1.6 | −10.5 | 830 | 250 | 250 | 19.0 | 4300 |
| 4 | A | 0.15 | 0.9 | 1.2 | −19.3 | 832 | 350 | 180 | 19.0 | 2350 |
| 5 | B | 0.10 | 1.5 | 1.2 | −44.2 | 832 | 580 | 0 | — | 25 |
| 6 | B | 0.10 | 1.5 | 1.2 | −10.3 | 833 | 350 | 280 | 19.0 | 6320 |
| 7 | B | 0.10 | 1.5 | 1.2 | −12.3 | 830 | 350 | 260 | 19.0 | 3630 |
| 8 | B | 0.10 | 1.5 | 1.6 | −15.7 | 832 | 300 | 310 | 19.0 | 2530 |

| No | Cooling zone Gas flow rate ($Nm^3$/hr) | Target decarburized layer thickness (μm) | Calculated decarburized layer thickness D (μm) | Decarburized layer evaluation | Alloying treatment Alloying temperature (° C.) | Coating appearance | Tensile strength (MPa) | Category |
|---|---|---|---|---|---|---|---|---|
| 1 | 350 | — | 0.1 | — | 565 | Poor | 955 | Comparative Example |
| 2 | 350 | ≤20 | 21.3 | Poor | 515 | Good | 972 | Comparative Example |
| 3 | 350 | ≤20 | 16.1 | Good | 520 | Good | 990 | Example |
| 4 | 350 | ≤20 | 12.2 | Good | 524 | Good | 1021 | Example |
| 5 | 350 | — | 0.1 | — | 570 | Poor | 752 | Comparative Example |
| 6 | 350 | ≤20 | 32.8 | Poor | 513 | Good | 771 | Comparative Example |
| 7 | 350 | ≤20 | 18.5 | Good | 519 | Good | 795 | Example |
| 8 | 350 | ≤20 | 9.6 | Good | 526 | Good | 802 | Example |

INDUSTRIAL APPLICABILITY

It is thus possible to provide a method for manufacturing a hot-dip galvanized steel sheet whereby favorable coating appearance can be obtained with high coating adhesion without a decrease in tensile strength even in the case of hot-dip galvanizing a steel sheet whose Si content is 0.2 mass % or more.

REFERENCE SIGNS LIST

100 continuous hot-dip galvanizing device
10 heating zone
12 soaking zone
14 first cooling zone (rapid cooling zone)

16 second cooling zone (slow cooling zone)
18 snout
20 annealing furnace
22 hot-dip galvanizing bath
23 alloying line
24 dry gas distribution device
26 humidifying device
28 circulating constant-temperature water bath
30 humidified gas distribution device
32 dry gas pipe
33 dry gas flowmeter
34, 36 humidified gas pipe
38 humidified gas flowmeter
40 humidified gas dew point meter
42A, 42B, 42C humidified gas supply port
44A, 44B, 44C humidified gas supply port
46A, 46B, 46C humidified gas supply port
48A, 48B, 48C, 48D dry gas supply port
50 dew point measurement port
52A upper hearth roll
52B lower hearth roll
60 CO concentration meter
P steel sheet

The invention claimed is:

1. A method for manufacturing a hot-dip galvanized steel sheet using a continuous hot-dip galvanizing device that includes: an annealing furnace in which a heating zone, a soaking zone, and a cooling zone are arranged in the stated order; and a hot-dip galvanizing line located downstream of the cooling zone, the method comprising:

annealing a steel sheet by conveying the steel sheet through the heating zone, the soaking zone, and the cooling zone in the stated order in the annealing furnace; and applying a hot-dip galvanized coating onto the steel sheet discharged from the cooling zone, using the hot-dip galvanizing line, wherein the steel sheet is heated in the heating zone using indirect heating, a reducing or non-oxidizing humidified gas and a reducing or non-oxidizing dry gas are supplied into the soaking zone, a CO gas concentration is measured using a CO gas concentration meter provided in an exhaust portion for gas in the soaking zone, a decarburized layer thickness of the steel sheet is calculated from the measured CO gas concentration, and at least one of a flow rate and a dew point of the humidified gas is controlled so that the calculated decarburized layer thickness is less than or equal to a 20 μm.

2. The method for manufacturing a hot-dip galvanized steel sheet according to claim 1, wherein the decarburized layer thickness is calculated based on the following Formula (1):

$$D=9.53\times10^{-7}\times V\cdot Gco/(LS\cdot W\cdot C) \quad (1)$$

where D is the decarburized layer thickness in μm, V is an amount of gas flowing into the soaking zone in $Nm^3/hr$, Gco is the CO gas concentration in ppm, LS is a sheet passing speed in m/s, W is a sheet width of the steel sheet in m, and C is a carbon content of the steel sheet in mass %.

3. The method for manufacturing a hot-dip galvanized steel sheet according to claim 1, wherein the continuous hot-dip galvanizing device includes an alloying line located downstream of the hot-dip galvanizing line, and the method further comprises heat-alloying the galvanized coating applied on the steel sheet, using the alloying line.

4. The method for manufacturing a hot-dip galvanized steel sheet according to claim 2, wherein the continuous hot-dip galvanizing device includes an alloying line located downstream of the hot-dip galvanizing line, and the method further comprises heat-alloying the galvanized coating applied on the steel sheet, using the alloying line.

* * * * *